US005877706A

United States Patent [19]

Summersgill

[11] Patent Number: 5,877,706

[45] Date of Patent: Mar. 2, 1999

[54] FERROMAGNETIC OBJECT DETECTOR

[75] Inventor: James E. Summersgill, Landisville, Pa.

[73] Assignee: Preferred Security Components, Inc of PA, Lancaster, Pa.

[21] Appl. No.: 863,824

[22] Filed: May 27, 1997

[51] Int. Cl.[6] ..... G08G 1/01

[52] U.S. Cl. ..... 340/933; 340/941; 324/207.13

[58] Field of Search ..... 340/938, 941, 340/933, 551, 552, 561, 562; 324/207.13, 207.15, 207.16

[56] References Cited

U.S. PATENT DOCUMENTS

| | | | |
|---|---|---|---|
| 2,943,306 | 6/1960 | Gray et al. | 340/551 |
| 3,237,155 | 2/1966 | Brockett | 340/551 |
| 3,373,374 | 3/1968 | Marosi | 340/551 |
| 3,397,364 | 8/1968 | Crandall | 340/551 |
| 3,541,347 | 11/1970 | Carmack | 340/551 |
| 3,582,932 | 6/1971 | Chapman | 340/551 |
| 3,609,679 | 9/1971 | Updegraf et al. | 340/551 |
| 3,745,450 | 7/1973 | Wilt | 340/551 |
| 3,818,430 | 6/1974 | Williams | 340/551 |
| 5,367,198 | 11/1994 | Buergel et al. | 340/551 |
| 5,534,849 | 7/1996 | McDonald et al. | 340/551 |

*Primary Examiner*—Jeffery A. Hofsass
*Assistant Examiner*—Daryl C. Pope
*Attorney, Agent, or Firm*—Martin Fruitman

[57] ABSTRACT

The apparatus is a detector for ferromagnetic objects using a small passive coil to sense disturbances in the earth's magnetic field when an object moves near the coil. The circuit uses a multiplier in the form of an electronic switch on the output of the coil to impose a much higher frequency on the output of the coil. This separates the frequency of amplification from the frequency of the coil signal and makes it possible to sharply filter the signal, prevent false alarms from electrical noise, identify the direction in which the object is moving, and reduce the power consumed through the use of a sampling technique. The frequency conversion technique also allows for multiplexing of multiple coils by one signal processing circuit.

16 Claims, 3 Drawing Sheets

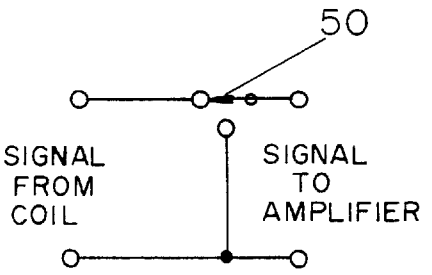
FIG. 3A
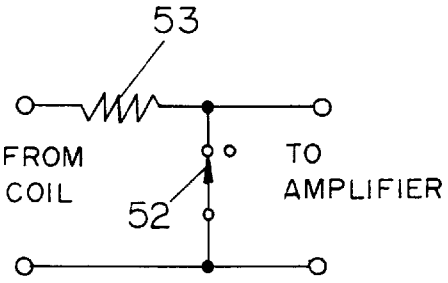
FIG. 3B
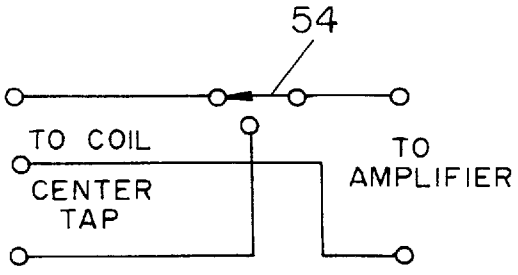
FIG. 3C
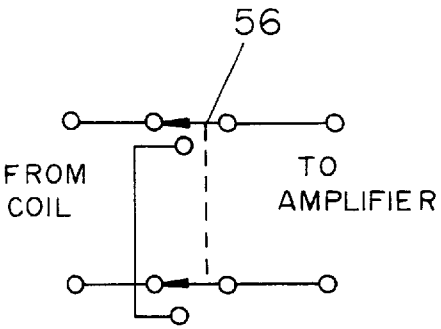
FIG. 3D
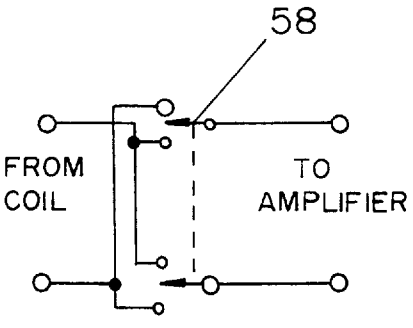
FIG. 3E
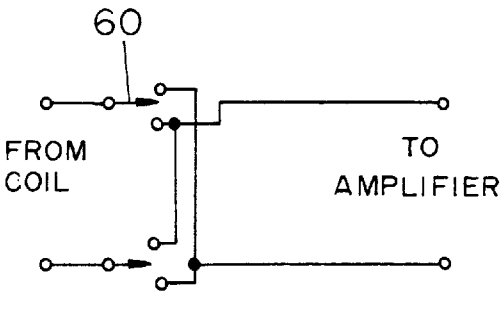
FIG. 3F
FIG. 3

FERROMAGNETIC OBJECT DETECTOR

BACKGROUND OF THE INVENTION

This invention deals generally with condition responsive indicating systems based on disturbances of magnetic fields and more specifically with ferromagnetic object detectors such as vehicle detectors.

Use of the earth's magnetic field as a basis for detection of ferromagnetic objects such as vehicles is not new. U.S. Pat. No. 3,237,155 to Brockett discloses such a system which is typical of many prior art devices that use an amplifier operating at the base band frequency of the signal input along with classical frequency filtering to attempt to overcome the several sources of electrical noise which can affect such a circuit.

The input signal for such devices is generated by the distortion of the earth's magnetic field which occurs when a large ferromagnetic object such as a vehicle moves within the magnetic field. The vehicle actually bends the magnetic lines of force near it as it concentrates those lines into its ferromagnetic body. This distortion moves along with the vehicle and can best be envisioned as an electromagnetic wave motion which causes a changing magnetic field in any location as the vehicle approaches and departs from the location. A coil of wire located in such a region with a changing magnetic field has a current generated in it and a corresponding voltage developed across it in accordance with the laws of electromagnetic induction.

The important characteristics of the currents generated in a passive sensing coil by the motion of a vehicle through the earth's magnetic field are that the voltages are very low frequency and very low amplitude, and these are the factors which have made prior art vehicle detector circuits unreliable. Weak signals are always subject to problems with extraneous electrical noise. Such noise may be internally generated by the circuit components themselves or from external sources such as power lines, lightning, and radio frequency generators, and even though band pass frequency filters have traditionally been used in vehicle detection circuits, such electrical noise can actually enter the circuits, or be generated within them, at locations throughout the band pass filter and amplifier stages.

The noise problem is made more difficult by the very low frequency generated by the magnetic sensing coils. The typical input frequency for vehicle detection circuits is between 0.1 Hz and 5 Hz, and the typical amplifiers used for such circuits are band pass amplifiers operated at the base band frequency of the sensing coil output and having a practical bandwidth of 0.5 Hz to 5.0 Hz. The lower end frequency of such amplifiers is limited because the overwhelming effects of low frequency noise and temperature drift generated within the circuit components have increasing effect below 1 Hz. Also internally present within the circuits are spurious noise transients, and all these noise and drift factors combine with externally generated noise. The base band approach also has problems in that all these noise components manifest themselves in oscillation or "ringing" of the band pass amplifiers at the base band frequency. Since this frequency is similar to that produced by the sensing coil, it becomes extremely difficult to distinguish such noise generated false signals from true detection.

Since such low frequency amplifiers are AC coupled, they require very large capacitors which also add to the noise problems because of internal leakage. Another problem is that the physical size of the circuits can not be reduced below the substantial size of the capacitors. A more subtle difficulty encountered due to the large capacitors is slow amplifier power up times, because of the charging times required for such large capacitors. This means that the amplifiers must be left on continuously which results in high power consumption. An unsatisfactory compromise is to reduce the size of the capacitors by discarding the lowest of the frequencies generated by the magnetic coil sensor.

SUMMARY OF THE INVENTION

The present invention takes a different approach to the problem of the low voltage, low frequency signal generated by magnetic sensor loops. The invention is a ferromagnetic object detector which uses a small passive coil to sense disturbances in the earth's magnetic field when a vehicle moves in the vicinity of the coil, but beginning with the very first circuit stage following the coil the invention departs from the traditional approach to such detectors.

The invention uses a signal multiplier, configured using an electronic switch operating on the output of the coil, to impose a much higher frequency on the signal originating from the coil. This makes makes it possible to provide amplification at a frequency different from that of the original coil output and provides a mechanism by which circuits or computer digital logic may process the resulting high frequency signal to prevent false alarms from electrical noise. The signal multiplier is essentially an electronic switch modulator, but it differs from traditional modulators in that, because it essentially mathematically multiplies the low frequency analog output of the coil and the high frequency digital signal of the carrier, there is no resulting output when either signal is zero. This yields an important benefit because sampling techniques can be used for noise suppression since no output signal is present between samples, because the carrier signal can be turned off between samples. The multiplier circuit is similar in its effect on the signal to a simple electronic switch chopper operated at a high frequency switching rate relative to the frequency of the coil signal. Thus, the result is a high frequency signal, typically within the audio spectrum, with its amplitude modulated by an exact representation of the signal generated in the coil.

The preferred embodiment of the invention connects the coil directly to the input of a multiplier stage which is driven by a carrier generator, so that the output of the multiplier stage is the high frequency carrier modulated by the coil signal. This high frequency output is then fed to a band pass amplifier which can be sharply tuned for the known carrier frequency. This arrangement differs from the prior art base band amplification technique operating with low frequency band pass filters with a broad band pass spectrum, because the amplifiers of the invention are operated at a frequency far removed from the effects of low frequency noise and temperature drift. Sharply tuning the amplifiers to the carrier signal is essential and allows the phase angle of the amplifier output to be checked against the carrier signal resulting in an extremely narrow band of acceptable frequencies, thus eliminating all extraneous noise that occurs out of the band.

The band pass amplifier is followed by a peak level detector which generates a single amplitude output only when its input signal is above a prescribed minimum level, and this becomes an initial verification that the coil signal has achieved a sufficient strength to warrant additional consideration as a valid signal. The signal is thereby converted into a series of sharply defined pulses of the high frequency signal which closely correspond to the half cycles of the low frequency waveform generated at the coil, and these pulses contain identifying characteristics relating to their origin.

This pulsed signal can then be processed in numerous ways by conventional logic circuitry to determine that it is validly generated and not the result of noise, because the original 25–100 micro volt signal in the sensing coil has been converted to standard digital logic levels by the amplifier and peak level detector.

In the preferred embodiment the peak detector is followed by parallel positive and negative signal latches which are alternately driven by the positive and negative cycles of the high frequency carrier, and the outputs of the latch circuits are fed to an EXCLUSIVE OR logic circuit. Thus, the output from the positive latch circuit occurs only if the positive peaks of the signal applied to the positive latch circuit appear at exactly the same time as the positive peaks of the carrier, and the output from the negative latch circuit also occurs only if the positive signal peaks applied to the negative latch circuit occur at the exact same time as the negative peaks of the carrier. The result of this arrangement is such that for valid coil signals the positive latch only will produce an output when the coil signal is positive and the negative latch will only produce an output when the the coil signal is negative. For noise disturbances out of the acceptable band, the peak detector pulses will appear shifted out of correct time relation to the carrier such that neither latch will produce an output. The output of the EXCLUSIVE OR logic then occurs only if one or the other of the latch circuits have delivered the appropriate outputs. Further, the EXCLUSIVE OR logic will not produce an output if both latches are providing an output, since such an occurrence could only be the result of noise disturbance because the coil signal can not be both positive and negative at the same time.

The preferred embodiment of the invention then performs another check. It includes a timing circuit which follows the EXCLUSIVE OR logic. This circuit verifies that the signal has continued for a time sufficiently long to verify that the signal being processed was generated by a vehicle affecting the coil. This feature prevents environmental electrical noise from creating a false signal because such noise originating in the high frequency band pass amplifier typically generates a disturbance for only the time during which the noise is generated, and such times are usually very short compared to the length of the legitimate signal from the sensing coil. This is a fundamental advantage over the prior art base band systems whose amplifiers are disturbed over time periods equal to legitimate signal lengths. If this final criterion is met, the timing circuit generates a conventional output logic pulse which can be used to control any application specific device such as an alarm signal, a gate, or a traffic light.

The present invention thereby dramatically reduces interference by electrical noise because it performs signal amplification at a frequency unhampered by low frequency noise and temperature drift, by using phase analysis actively filters the signal through a much narrower band than is possible when dealing directly with the sensing coil frequency, verifies that invalid conditions of simultaneous positive and negative coil signal indications do not exist, and, finally, verifies if the signal being processed exists for a sufficient length of time. All of this is made practical by the higher frequency of amplification available because of the carrier multiplication technique and because of the signal multiplier mechanism itself.

Furthermore, the present invention yields several other advantages. Because of the use of the carrier, the circuit actually can amplify and detect a signal which is of lower frequency than those circuits which have been previously available. The present circuit recovers signals down to DC, and can therefore use all characteristics of the signal for discrimination from noise, and further, this provides such accurate capturing of the character of the original signal that it becomes possible to determine object direction based upon the signature of the signal. The high frequency carrier also permits the use of much smaller capacitors in the circuit, and this permits both miniaturization and very short power up time. This latter benefit permits using the circuit in a sampling mode in which major power consuming portions of the circuit are turned on for as little as one tenth of the time. This low duty factor dramatically reduces the power consumption of the circuit, but loses no information because the sample rate can easily be much faster than the low frequency of the coil signal.

The present invention thereby furnishes a vehicle detector with lower noise sensitivity, lower power consumption, and greater versatility than the prior art systems.

BRIEF DESCRIPTION OF THE DRAWINGS

FIG. 3A–3F are a group of schematic diagrams of several alternate types of electronic switches suitable for use in the invention.

DETAILED DESCRIPTION OF THE INVENTION

Figure 1:
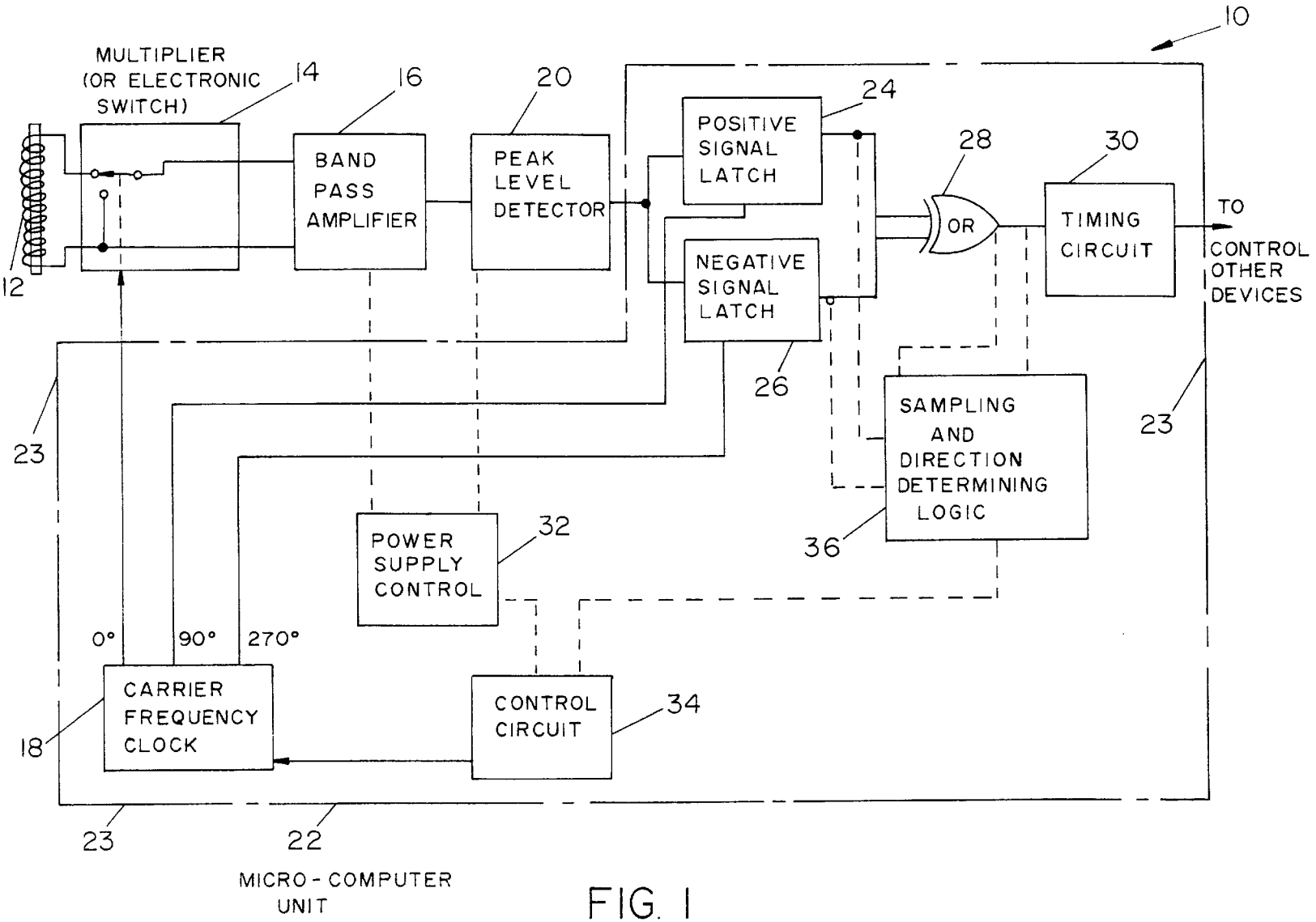
FIG. 1 is a schematic block diagram of the preferred embodiment of the invention.

FIG. 1 is a schematic diagram of the preferred embodiment of ferromagnetic object detector 10 in which sensing coil 12, which is placed in a location where such items as vehicles will pass nearby, is connected to multiplier 14, and the output of multiplier 14 is connected to the input of band pass amplifier 16. It should be appreciated that multiplier 14 is, in most respects, the equivalent of a simple electronic switch which is pictured within the schematic block of multiplier 14. Thus, when carrier frequency clock 18 is operated to control multiplier 14, the very low frequency voltage generated at coil 12 is interrupted at the carrier frequency. The resulting signal delivered to band pass amplifier 16 from multiplier 14 is the signal from coil 12 modulating the carrier frequency generated by clock 18.

However, because of the multiplying action, the carrier frequency is not fed through to band pass amplifier 16 unless there is signal generated by sensing coil 12. This action differs from that of the classic modulator which produces a continuous carrier signal even when the modulating signal is not on. The multiplier circuit used in the invention furnishes particular opportunities for noise suppression.

In the preferred embodiment, coil 12 generates a current of 25–100 micro volts at a frequency of less than 5 Hz, and the carrier frequency is within the audio spectrum. This signal is fed to band pass amplifier 16 which is sharply tuned to the carrier frequency being used, so that all other frequencies are blocked out. Band pass amplifier 16 raises the signal amplitude and feeds the stronger signal to positive peak level detector 20, which is essentially a logic circuit which produces a single positive level voltage on its output whenever its input is raised above a certain specified level.

The output of peak level detector 20 is essentially a series of positive pulses having a particular phase relationship to the carrier frequency with the presence of bursts of pulses approximating the half cycles of the original signal from coil 12. Such a signal is suitable for use in most logic circuits, and the preferred embodiment of the invention uses the signal pulses in a logic circuit to verify that the resulting control signal were, in fact, generated by a large ferromagnetic object, and that the signal did not originate from extraneous electrical noise.

The noise discrimination circuits which are described below are largely described in terms of discrete functional circuits, but it should be appreciated that, with the current state of the art, most the circuits discussed below, and also carrier frequency clock 18 already discussed, can be replaced with single micro-computer unit 22. These circuits are shown enclosed by dashed line 23.

The output signal from peak level detector 20, pulses related to the high frequency carrier signal, are applied to the inputs of both positive signal latch 24 and negative signal latch 26, while clock signals from carrier frequency clock 18 are applied to the clock inputs of positive signal latch 24 and negative signal latch 26.

However, the clock signals applied to latch circuits 24 and 26 have different phase relationships, and they also differ in phase from the carrier frequency clock signal supplied to multiplier 14. As noted on FIG. 1, The phase angle of the clock frequency supplied to multiplier 14 is considered to be at 0 degrees, that is, it is supplied at the beginning of each cycle, the instant each high frequency cycle crosses the zero signal point. Quite simply, this is because the clock signal is the carrier frequency signal. The signal supplied to positive signal latch 24 is then supplied at 90 degrees, and the signal supplied to negative signal latch 26 is at 270 degrees. Such deviations are a simple matter to supply either when using discrete components or computer software, because only one carrier frequency is ever used in any circuit.

The clock activated signal latches, 24 and 26, then perform a very accurate noise elimination function based on a phase comparison of the clock signal against the peak detector signal. Since the clock signal essentially activates the latch, positive signal latch 24 is only able to accept the signal on its input at exactly 90 degrees after the clock signal begins, that is, at the positive peaks of the carrier signal. This condition will only occur for legitimate signals derived from the combination of carrier signal and a positive coil signal. Alternately, negative signal latch 26 is only able to accept signal on its input at exactly 270 degrees after the clock signal begins, that is, at the negative peaks of the carrier signal. This condition will only occur for legitimate signals derived from the combination of carrier signal and negative coil signal. Since noise signal outside of the selected band will cause a disturbance to band pass amplifier 16 that is shifted in phase relative to that which is derived from legitimate coil signal, the pulses from peak detector 20 will not arrive at latches 24 and 26 at the correct time and neither latch will produce an output. For further clarification, it should be understood that the positive and negative signal latches are so named because they produce an output which is indicative of the polarity of the signal being generated within the coil, and neither latch will produce an output when the coil signal is near or at zero. Furthermore this obviously means that both latches cannot simultaneously produce output since it is electrically impossible for any coil signal to be both positive and negative at the same time. Lastly, neither latch will produce an output if it receives signal on its input which is not the correct expected phase relative to the clock.

The outputs of latch circuits 24 and 26 are fed to EXCLUSIVE OR logic circuit 28. The output of the EXCLUSIVE OR 28 then occurs only if one or the other of the two latch circuits have delivered their appropriate outputs, and not simultaneously. This exclusion of simultaneous signals is an additional guard against noise since, as previously discussed, such a condition could not possibly have been created by legitimate coil signal, and therefore must have been the result of noise disturbance.

The preferred embodiment of the invention then performs another check. The output of EXCLUSIVE OR 28 is supplied to timing circuit 30. Timing circuit 30 verifies that its input signal has continued for a time sufficiently long to verify that the input signal was generated by a vehicle affecting the coil. This feature places a further restriction upon environmental electrical noise because such noise, which is most likely to originate in band pass amplifier 16, typically creates a disturbance for only the time during which the noise is generated, and such times are usually very short compared to the length of the legitimate signal from sensing coil 12. This is due to the higher frequency of amplification used compared to the prior art low frequency base band technique. If this final criterion is met, that is, only if the signal supplied to timing circuit 30 from EXCLUSIVE OR 28 is maintained for a specific length of time, timing circuit 30 generates a conventional output logic pulse which can be used to control other operating devices such as an alarm signal, a gate, or a traffic light (not shown).

FIG. 1 also shows two optional features of the invention. The connections of these circuits within FIG. 1 are shown with dashed lines. Because of the rapid response time of high frequency band pass amplifier 16 and the relatively low frequency of the signal generated by coil 12, it is actually practical to cycle the power to amplifier 16 and to peak level detector 20 and still secure all the information needed to fulfill the requirements of the invention. Thus, power supply control 32 is cycled at the frequency of 8 Hz and at a duty factor of 0.1 by control circuit 34, and this action reduces the power consumptions of band pass amplifier 16 and peak level detector 20 to approximately 10% of what they would otherwise be. Since the amplifier and the peak level detector use much of the power in the circuit, this cycled operation significantly reduces the overall power consumption of the entire circuit.

The cycling of power supply 32 does make the insertion of sampling circuit 36 between EXCLUSIVE OR 28 and timing circuit 30 desirable to verify that signals generated are properly timed with the action of power supply 32. Such a sampling circuit is made up of conventional logic circuits into which are fed the same timing signal which controls power supply 32. The very act of sampling at a 10% duty factor eliminates extraneous noise for 90% of the time. A lightning strike must, for instance, occur during the 10% on time, or it can not have any affect on the circuit.

Since the original signal generated within sensing coil 12 differentiates the direction of a passing vehicle based upon whether the first cycle generated by the coil is positive or negative going, it becomes very important that the coil signal received retains its full spectral character and is uncolored by the adjoining signal processing. Since prior art base band systems have difficulties in this regard, they are limited with respect to direction determination. As discussed, the carrier band technique of the present invention is capable of accurate signal processing throughout the entire spectral distribution of the coil signal. Therefore it is possible with conventional logic circuitry to determine the direction of a passing vehicle. Such directional determining logic can either be combined with sampling circuit 36 or can be inserted as an independent circuit between EXCLUSIVE OR 28 and timing circuit 30.

The components and parameters used in the preferred embodiment of the invention shown in FIG. 1 are listed below.

Sensing Coil 12–15,000 turns of 36 AWG wire on steel core of ½ inch diameter 9.5 inches long.

Switching multiplier 14—one section of National Semiconductor model CD4053BCN operated at 2.0 kHz.

Band Pass Amplifier 14—two sections of National Semiconductor model LM346J with center frequency adjusted for 2.0 kHz by discrete components.

Peak Level Detector 20—one section of National Semiconductor model LM346J.

Micro-Computer Unit 22—Motorola model MC68HC705J1A

Multiplier Carrier Frequency—2.0 kHz.

Power Supply—5.0 VDC.

Frequency of Power Supply Control 32 On/Off—8 Hz

Power Supply Duty Factor—0.1

Band Pass Amplifier 14 Time On—12 MS

Figure 2:
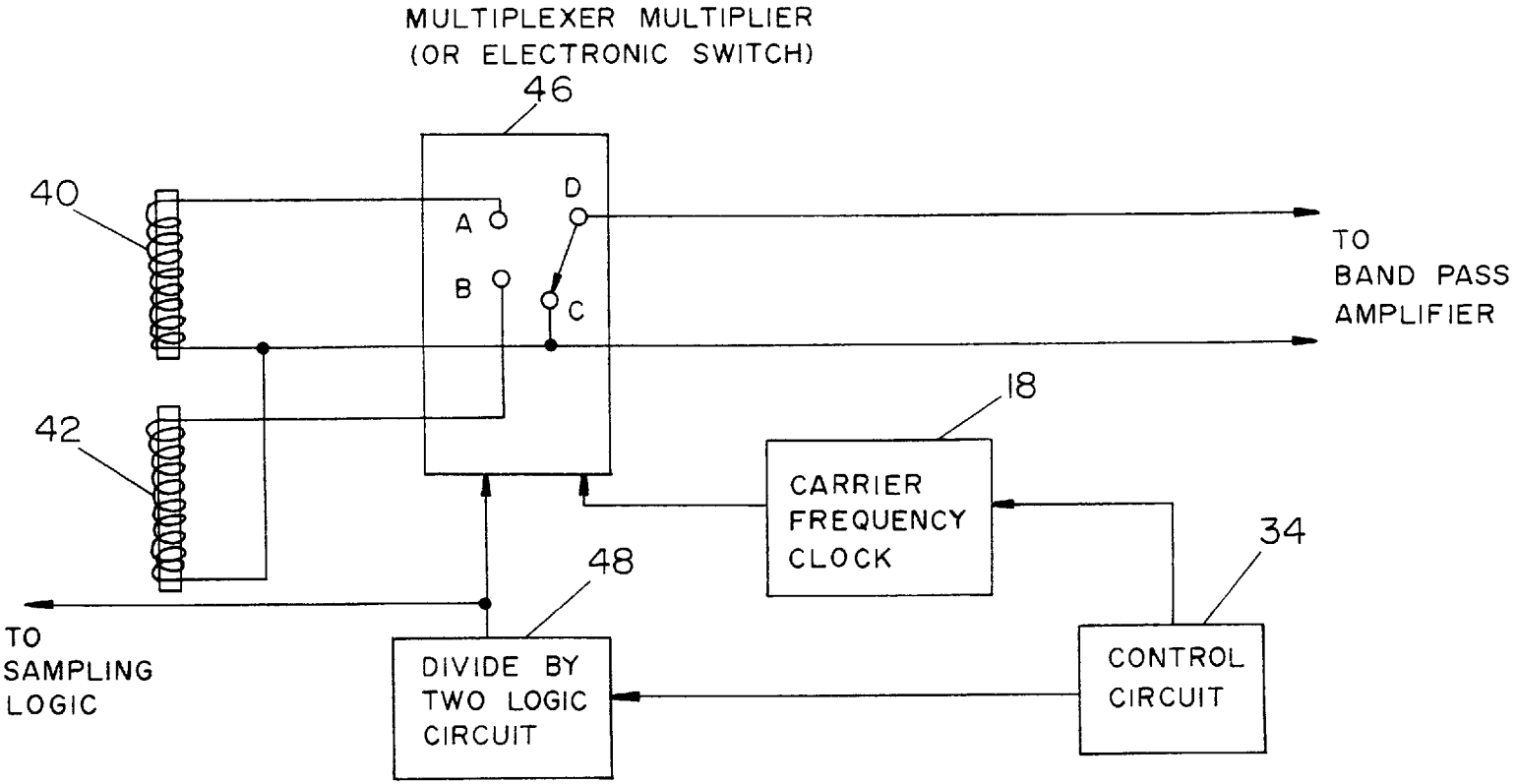
FIG. 2 is a schematic block diagram of an alternate embodiment of the invention using multiplexed coils.

FIG. 2 is a schematic block diagram of an alternate embodiment of the invention using multiplexed coils. Such an embodiment uses the same circuitry as discussed in regard to the power saving sampling circuit of FIG. 1. In FIG. 2 coils 40 and 42, electronic switch 46, and divide by two logic circuit 48 are shown as a substitute for coil 12 and electronic switch 14 of FIG. 1. The balance of the embodiment shown in FIG. 1 remains the same. Carrier frequency clock 18 and control circuit 34 in FIG. 2 are the same as in FIG. 1 and are shown in FIG. 2 for clarity. In FIG. 2, multiple sensing coils such as 40 and 42 are placed in different locations and connected to electronic switch 46. The zero degree signal of carrier frequency clock 18 is fed to electronic switch 46, and it is arranged that this signal will unconditionally force switch pole D to be connected to contact position C and away from any other contact positions during the half cycles of the clock. This causes the same signal multiplication or modulation on the coil output as previously described for multiplier 14 of FIG. 1. Control circuit 34 provides a signal corresponding to each sample period, and this is coupled through divide by two logic circuit 48 to electronic switch 46. It is arranged that electronic switch 46 will receive the divided signal as a sequence clock for connecting switch pole D to contact position A, then to position B, and then back to position A, thus restarting the sequence cycle. Therefore, for each sample period generated by control circuit 34, a different coil is selected for sampling and its output is simultaneously modulated. The sequence signal of divide by two logic circuit 48 is provided to the sampling logic of FIG. 1 so as to provide an identification of which coil is being sampled.

The embodiment of FIG. 2 permits the use of one signal processing unit for multiple individual and widely separated coils. It should be appreciated that alternate switching devices having multiple contact positions may be substituted for electronic switch 46 allowing for an even greater number of coils. In such a case alternate sequence logic arrangements may be substituted for divide by two logic circuit 48, and the appropriate sequence control signals would be provided. It should further be apparent that the integral modulation action occurring within electronic switch 46 could be segregated as a separate multiplier or modulator stage connected to the carrier signal and following the switch, and in such an arrangement electronic switch 46 would not use the carrier signal as discussed at all but would still sequence among the coils, multiplexing them as described. It should also be noted that the sampling rate must be increased along with the number of coils multiplexed, so that each coil is sampled at the minimum required rate. Finally, it should be noted that there is no theoretical limit on the number of coils which could be multiplexed, however, there are a multitude of practical limitations on the number, and a discussion of these is outside the scope of the treatment presented. The embodiment of FIG. 2 therefore permits the use of one signal processing unit to monitor several coils, and this benefit is a direct result of the use of the carrier modulation technique but would not be possible in prior art base band systems. Such an arrangement could be used, for example, to count the vehicles entering a parking lot through several different entrances or to perform complex situation analysis and control of congested traffic zones.

FIGS. 3A–3F are a group of schematic diagrams of several alternate types of electronic switches suitable for use in the invention. FIG. 3A shows simple SPDT switch 50 identical to the switch shown in multiplier 14 of FIG. 1. Switch 50 functions to alternately connect the coil signal to the following amplifier or to short out the amplifier input to reduce its input signal to zero.

FIG. 3B shows SPST switch 52 which either shorts out the amplifier input or leaves it connected to the coil through resistor 53. Resistor 53 prevents the coil signal from also being shorted out, which will neutralize the coil output.

FIG. 3C–3F are balanced stages which are particularly suitable for use where the sensing coil is far removed from the electronic switch/multiplier input, and is connected by means of a balanced transmission line. The use of SPDT switch 54 in FIG. 3C requires the use of a center tapped sensing coil.

FIG. 3D uses DPDT switch 56 to either short the amplifier input or connect it across the coil. FIGS. 3E and 3F, which use DPDT switches 58 and 60 respectively, alternate the connection of the switch inputs to the switch outputs. This has the advantage of doubling the input signal to the following amplifier.

It should be appreciated that although the various embodiments of the electronic switch are shown in FIG. 3 in simplified schematic form, the electronic switch performs a multiplication task. This task can be implemented by various means and may be independent of the electronic switching action. For example, circuitry which uses discrete bipolar or field effect transistors is possible, and fully analog integrated operational multiplier units may be incorporated and are available commercially. The preferred embodiment of the invention uses fully integrated analog electronic switching elements with field effect transistors. Various arrangements are possible as shown, and each has unique advantages, but all perform the same multiplication or modulation function combining the signal from the sensing coil with the higher frequency carrier frequency.

As can be appreciated from the preceding description of the invention, the present invention furnishes a ferromagnetic object sensor which is sensitive to ferromagnetic objects but immune to extraneous noise and is also capable of capturing the full object signature which permits object identification modes such as direction identification. Moreover, it uses less power than previously available circuits, and can also be used with multiple sensing coils to monitor several locations simultaneously.

It is to be understood that the form of this invention as shown is merely a preferred embodiment. Various changes may be made in the function and arrangement of parts; equivalent means may be substituted for those illustrated and described; and certain features may be used independently from others without departing from the spirit and scope of the invention as defined in the following claims.

For example, other forms of modulation could be used to combine the signal from the sensing coil and the higher frequency carrier, and, as noted previously, other configurations of electronic switches and other signal processing logic circuits can be used.

What is claimed as new and for which Letters Patent of the United States are desired to be secured is:

1. An apparatus for detecting ferromagnetic objects comprising:

at least one coil generating an electrical signal when a ferromagnetic object moves through the earth's magnetic field in proximity to the coil;

carrier signal generator means producing a carrier signal of a frequency higher than the electrical signal generated by the coil;

modulator means interconnected with the coil and with the carrier signal generator means and producing a combined signal from the electrical signal generated by the coil and the carrier signal;

band pass amplifier means interconnected with the modulator means, receiving the combined signal, and producing a filtered signal; and signal processing means interconnected with the band pass amplifier means, receiving the filtered signal, and converting the filtered signal into a control signal for operating devices.

2. The apparatus of claim 1 wherein the modulator means is a multiplier.

3. The apparatus of claim 1 wherein the modulator means is an electronic switch interrupting the signal generated by the coil at the frequency of the carrier signal.

4. The apparatus of claim 1 wherein the modulator means is an electronic switch reversing the output of the connections to the coil at the frequency of the carrier signal.

5. The apparatus of claim 1 wherein the signal processing means and the carrier signal generator are parts of a micro computer unit.

6. The apparatus of claim 1 wherein the signal processing means includes level detection means which is interconnected with the band pass amplifier and verifies that the filtered signal has achieved a minimum specified amplitude.

7. The apparatus of claim 1 wherein the signal processing means includes at least one phase comparison means which verifies that the filtered signal is in phase with the carrier signal.

8. The apparatus of claim 1 wherein the signal processing means includes a polarity determining means which provides indications of both positive and negative signal polarity generated by the coil.

9. The apparatus of claim 8 wherein the signal processing means includes a noise cancellation means interconnected with the polarity determining means which prevents a control signal when simultaneous opposite polarities are indicated by the polarity determining means.

10. The apparatus of claim 1 wherein the signal processing means includes a timing circuit which verifies that the filtered signal continues for a minimum specified time.

11. The apparatus of claim 1 wherein the signal processing means includes a power saving circuit which repeatedly turns the power supply of the band pass amplifier off for a time sufficient to reduce the duty factor of the band pass amplifier.

12. The apparatus of claim 11 wherein the signal processing means includes circuitry to receive the filtered signal only when the band pass amplifier is on.

13. The apparatus of claim 1 wherein the filtered signal has a center frequency the same as the carrier signal frequency.

14. The apparatus of claim 1 wherein the signal processing means includes means to determine the direction of movement of a ferromagnetic object relative to the coil.

15. The apparatus of claim 1 further including more than one coil, an electronic switch which switches the signal supplied to the modulator means between the coils, and the signal processing means includes means to identify the coil from which the signal is originating at any time.

16. The apparatus of claim 15 wherein the modulator means is integrated with the electronic switch.

* * * * *